US006280168B1

(12) United States Patent
Matsumoto et al.

(10) Patent No.: US 6,280,168 B1
(45) Date of Patent: Aug. 28, 2001

(54) MULTI-CYLINDER ROTARY COMPRESSOR

(75) Inventors: Kenzo Matsumoto; Manabu Takenaka; Tsuyoshi Higuchi; Kazuaki Fujiwara; Dai Matsuura, all of Gunma (JP)

(73) Assignee: Sanyo Electric Co., LTD, Osaka (JP)

( * ) Notice: Subject to any disclaimer, the term of this patent is extended or adjusted under 35 U.S.C. 154(b) by 0 days.

(21) Appl. No.: 09/609,195

(22) Filed: Jun. 30, 2000

(30) Foreign Application Priority Data

Jul. 1, 1999 (JP) ..... 11-187898

(51) Int. Cl.[7] ..... F01C 21/00

(52) U.S. Cl. ..... 418/151; 418/60; 418/63; 418/150

(58) Field of Search ..... 418/60, 63, 151, 418/150

(56) References Cited

U.S. PATENT DOCUMENTS

| | | | | |
|---|---|---|---|---|
| 4,710,111 | * | 12/1987 | Kubo | 418/63 |
| 4,764,097 | * | 8/1988 | Hirahara et al. | 418/60 |
| 4,881,879 | * | 11/1989 | Ortiz | 418/63 |
| 4,915,554 | * | 4/1990 | Serizawa et al. | 418/151 |
| 5,006,051 | * | 4/1991 | Hattori | 418/60 |
| 5,104,297 | * | 4/1992 | Sekiguchi et al. | 418/63 |
| 5,230,616 | * | 7/1993 | Serizawa et al. | 418/151 |
| 5,314,318 | * | 5/1994 | Hata et al. | 418/60 |

FOREIGN PATENT DOCUMENTS

| | | | | |
|---|---|---|---|---|
| 61-187587-A | * | 8/1986 | (JP) | 418/60 |
| 61-205390-A | * | 9/1986 | (JP) | 418/60 |
| 1-257786-A | * | 10/1989 | (JP) | 418/60 |
| 3-291997-A | * | 12/1991 | (JP) | 418/63 |
| 5-187374-A | * | 7/1993 | (JP) | 418/60 |
| 7-247973-A | * | 9/1995 | (JP) | 418/60 |
| 1671975-A | * | 8/1991 | (SU) | 418/60 |
| 1740781-A | * | 6/1992 | (SU) | 418/60 |

* cited by examiner

*Primary Examiner*—Thomas Denion
*Assistant Examiner*—Theresa Trieu
(74) *Attorney, Agent, or Firm*—Darby & Darby

(57) ABSTRACT

An object of the present invention is to provide a multi-cylinder rotary compressor which can eliminate a number of balancers for preventing vibrations. Assuming that the mass eccentricity in a cylinder is m1×r1; the mass eccentricity in another cylinder is m2×r2; the mass eccentricity of a balancer attached to the lower side of a rotator is m3×r3; the mass eccentricity of another balancer attached to the upper side of the rotator is m4×r4; respective distances from the cylinder to another cylinder, the lower balancer and another balancer are L2, L3 and L4, when the balancing is attained with the expressions m1×r1+m4×r4=m2×r2+m3×r3, m4×r4×L4=m2×r2×L2+m3×r3×L3, and m1×r1=m2×r2, the lower balancer is eliminated and the mass eccentricity of the balancer is set to be not less than 20% and not more than 80% of m4×r4.

1 Claim, 10 Drawing Sheets

| | PRIOR ART | PRESENT INVENTION | | | | |
|---|---|---|---|---|---|---|
| | | X=0 | X=0.2 | X=0.5 | X=0.8 | X=1 |
| RADIAL MAXIMUM VIBRATION DISPLACEMENT | 1.0 | 1.7 | 1.3 | 1.2 | 1.3 | 1.7 |

MULTI-CYLINDER ROTARY COMPRESSOR

BACKGROUND OF THE INVENTION

1. Field of the Invention

The present invention relates to a multi-cylinder rotary compressor mounted in, for example, an air conditioner or a freezing machine.

2. Description of the Prior Art

This kind of conventional multi-cylinder rotary compressor 200 will be explained with reference to FIG. 10. In this drawing, reference numeral 201 denotes a closed container in which an electric motor 202 constituted by a DC brushless motor as an electric element is provided on the upper side and a rotary compression element 203 driven to rotate by the electric element 202 is accommodated on the lower side. The closed container 201 has a half-split structure composed of a cylindrical shell portion 201A whose upper end is opened and an end cap portion 201B for closing the upper end opening of the shell portion 201A, and it is constituted by fitting the end cap portion 201B on the shell portion 201A to be sealed by high frequency deposition and the like after accommodating the electric motor 202 and the compression element 203 in the shell portion 201A. Further, the bottom portion in the shell portion 201A of the closed container 201 is an oil bank B.

The electric motor 202 is constituted by a stator 204 fixed on the inner wall of the closed container 201, and a rotator 205 which is supported by a rotating shaft 206 extending in the axial direction of the cylinder of the closed container 201 and which is rotatable around the rotating shaft 206 on the inner side of the stator 204. The stator 204 is constituted by a stator core 274 configured by superimposing a plurality of stator iron plates having a substantially donut-like shape, and a stator winding (driving coil) 207 which is wound around a plurality of cog portions formed on the inner periphery of the stator core 274 by the distributed winding method and supplies the rotating magnetic field to the rotator 205. The outer peripheral surface of the stator core 274 is brought into contact with and fixed to the inner wall of the shell portion 201A of the closed container 201.

The rotary compression element 203 includes rotary cylinders 209 and 210 separated by an intermediate partition plate 208. Eccentric portions 211 and 212 driven to rotate by the rotating shaft 206 are attached to the respective cylinders 209 and 210, and the phases of these eccentric portions 211 and 212 are shifted from each other 180 degrees at the eccentric positions.

Reference numeral 213 and 214 designate a first roller and a second roller which rotate in the cylinders 209 and 210 respectively and turn in the cylinders by rotation of the eccentric portions 211 and 212. Reference numerals 215 and 216 denote a first bearing and a second bearing. The first bearing 215 forms a closed compression space of the cylinder 209 between itself and the intermediate partition plate 208 while the second bearing 216 forms a closed compression space of the cylinder 210 between itself and the intermediate partition plate 208. Further, the first bearing 215 and the second bearing 216 respectively include bearing portions 217 and 218 which rotatably pivot the lower portion of the rotating shaft 206.

Reference numerals 219 and 220 represent cup mufflers which are disposed so as to cover the first bearing 215 and the second bearing 216. It is to be noted that the cylinder 209 communicates with the cup muffler 219 via a non-illustrated communication hole formed to the first bearing 215, and the cylinder 210 also communicates with the cup muffler 220 via a non-illustrated communication hole formed to the second bearing 216. In addition, the lower cup muffler 220 communicates with the inside of the closed container 201 above the cup muffler 219 through a through hole 279 piercing each bearing or cylinder and a bypass pipe 221 attached to the outside of the closed container 201.

Reference numeral 222 denotes a discharge pipe provided above the closed container 210, and reference numerals 223 and 224 represent suction pipes leading to the cylinders 209 and 210. Moreover, reference numeral 225 designates a closed terminal which supplies power from the outside of the closed container 201 to the stator winding 207 of the stator 204 (a lead wire connecting the closed terminal 225 to the stator winding 207 is not illustrated).

Reference numeral 226 represents a rotator core of the rotator 205 which is obtained by superimposing a plurality of rotator iron plates punched out from an electromagnetic steel plate having a thickness of 0.3 mm to 0.7 mm in a predetermined shape and caulking them each other to be integrally layered.

In this case, the rotator iron plate of the rotator core 226 is punched out from the electromagnetic steel plate in such a manner that salient pole portions constituting four magnetic poles are formed, and a magnetic body (a permanent magnet) is inserted into the rotator core 226.

Reference numeral 251 is a rivet for caulking the rotator core 226; 272, a discoid oil separation plate attached to the rotator 205 at a position above the rotator 205; 273, an upper balancer attached between the plate 272 and the top face of the rotator core 226; and 284, a lower balancer attached to the bottom face of the rotator core 226.

With such a configuration, when the rotator winding 207 of the rotator 204 of the electric motor 202 is energized, the rotating magnetic field is formed to rotate the rotator 205. Rotation of the rotator 205 causes eccentric rotation of the rollers 213 and 214 in the cylinders 209 and 210 through the rotating shaft 206, and an intake gas absorbed from the suction pipes 223 and 224 is compressed.

The compressed high pressure gas is emitted from the cylinder 209 into the cup muffler 219 through the communication hole and discharged from a discharge hole formed to the cup muffler 219 into the upper (a direction of the electric motor 202) closed container 201. On the other hand, the gas is emitted from the cylinder 210 into the cup muffler 220 through the communication hole and further discharged into the closed container 201 above the cup muffler 219 via the through hole 279 and the bypass pipe 221.

The discharged high pressure gas passes a gap in the electric motor 202 to reach the discharge pipe 222 and is discharged outside. On the other hand, although the oil is contained in the gas, this oil is separated by the plate 272 and others before reaching the discharge pipe 222 and directed to the outside by the centrifugal force. Further, it flows down to the oil bank B through the passage formed between the stator 204 and the closed container 201.

FIG. 11 shows a multi-cylinder rotary compressor 300 using an AC motor as an electric motor. In this drawing, reference numeral 301 denotes a closed container in which an electric motor 302 composed of an AC motor (an induction motor) is accommodated on the upper side as the electric element and a rotary compression element 303 driven to rotate by the electric motor 302 is housed on the lower side. The closed container 301 has a half-split configuration made up of a cylindrical shell portion 301A whose upper end is opened and an end cap portion 301B for closing the upper opening of the shell portion 301A, and this closed container 301 is constituted by accommodating the electric motor 302 and the rotary compression element 303 in the shell portion 301A and thereafter fitting the end cap portion 301B to the shell portion 301A to be sealed by high frequency deposition and the like. The bottom portion in the shell portion 301A of the closed container 301 serves as an oil bank B.

The electric motor 302 is constituted by a stator 304 fixed on the inner wall of the closed container 301 and a rotator 305 which is supported by a rotating shaft extending in the axial direction of the cylinder of the closed container 301 and which is rotatable around the rotating shaft 306 on the inner side of the stator 304. The stator 304 is composed of a stator core 374 constituted by superimposing a plurality of stator iron plates having a substantially donut-like shape and a stator winding 307 provided to a plurality of cog portions formed on the inner periphery of the stator core 374. The outer peripheral surface of the stator core 374 is in contact with and fixed to the inner wall of the shell portion 301A of the closed container 301.

The rotary compression element 303 is provided with rotary cylinders 309 and 310 partitioned by an intermediate partition wall 308. Eccentric portions 311 and 312 driven to rotate by the rotating shaft 306 are attached to the respective cylinders 309 and 310, and the phases of the eccentric portions 311 and 312 are shifted from each other 180 degrees at eccentric positions.

Reference numerals 313 and 314 represent a first roller and a second roller which rotate in the respective cylinders 309 and 310 and turn in the cylinders by rotation of the eccentric portions 311 and 312. Reference numerals 315 and 316 denote a first bearing and a second bearing, respectively. The first bearing 315 forms a closed compression space of the cylinder 309 between itself and the intermediate partition plate 308, and the second bearing 316 forms a closed compression space between itself and the cylinder 310. The first bearing 315 and the second bearing 316 respectively include bearing portions 317 and 318 which rotatably pivot the lower portion of he rotating shaft 306.

Reference numerals 319 and 320 designate cup mufflers which are respectively attached so as to cover the first bearing 315 and the second bearing 316. It is to be noted that the cylinder 309 communicates with the cup muffler 319 through a non-illustrated communication hole formed to the first bearing 315 and the cylinder 310 also communicates with the cup muffler 320 via a non-illustrated communication hole formed to the second bearing 316. In addition, the lower cup muffler 320 communicates with the inside of the upper closed container 301 above the cup muffler 319 via a through hole 379 piercing each bearing or cylinder and a bypass pipe 321 provided to the outside the closed container 301.

Reference numeral 322 represents a discharge pipe provided above the closed container 301, and 323 and 324, suction pipes connected to the respective cylinders 309 and 310. Moreover, reference numeral 325 designates a closed terminal which supplies power from the outside of the closed container 301 to the stator winding 307 of the stator 304 (a lead wire for connecting the closed terminal 325 to the stator winding 307).

Reference numeral 326 denotes a rotator core of the rotator 305 which is obtained by superimposing a plurality of rotator iron plates punched out from an electromagnetic steel plate having a thickness of 0.3 mm to 0.7 mm in a predetermined shape and caulking them each other to be integrally layered. Reference numeral 330 represents a rotator winding.

Reference numeral 372 denotes a discoid oil separation plate attached to the rotating shaft 306 at a position on the upper side of the rotator 305; 373, an upper balancer attached to the upper surface of the rotator winding 330 which protrudes above the rotator 306; and 384, a lower balancer attached to the lower surface of the rotator winding 330.

With such a configuration, when the stator winding 307 of the stator 304 of the electric motor 302 is energized, the rotating magnetic field is formed to rotate the rotator 305. Rotation of the rotator 305 causes eccentric rotation of the rollers 313 and 314 in the cylinders 309 and 310 through the rotating shaft 306, and an intake gas absorbed from the suction pipes 323 and 324 is compressed.

The compressed high pressure gas is emitted from the cylinder 309 into the cup muffler 319 through the communication hole and discharged from a discharge hole formed to the cup muffler 319 into the upper (a direction of the electric motor 302) closed container 301. On the other hand, the gas is emitted from the cylinder 310 into the cup muffler 320 through the communication hole and further discharged into the closed container 301 above the cup muffler 319 via the through hole 379 and the bypass pipe 321.

The discharged high pressure gas passes a gap in the electric motor 302 to reach the discharge pipe 322 and is discharged outside. On the other hand, although the oil is contained in the gas, this oil is separated by the plate 372 and others before reaching the discharge pipe 322 and directed to the outside by the centrifugal force. Further, it flows down to the oil bank B through the passage formed between the stator 304 and the closed container 301.

In the meanwhile, the respective balancers 273 and 284 or 373 and 384 are provided for the purpose of canceling out the vibration caused due to the eccentric rotation of the rollers 213 and 214 or 313 and 314 in the respective cylinders 209 and 210 or 309 and 310. In such a case, assuming that the mass eccentricity in the cylinder 210 or 310 is m1×r1; the mass eccentricity in the cylinder 209 or 309 is m2×r2; the mass eccentricity of the balancer 284 or 384 is m3×r3; the mass eccentricity of the balancer 273 or 373 is m4×r4; a distance from the cylinder 210 or 310 to the cylinder 209 or 309 is L2; a distance to the balancer 284 or 384 is L3; and a distance to the balancer 273 or 373 is L4, the balance is attained when the following relationship is achieved.

$$m1\times r1+m4\times r4=m2\times r2+m3\times r3$$

$$m4\times r4\times L4=m2\times r2\times L2+m3\times r3\times L3$$

$$m1\times r1=m2\times r2$$

Therefore, the mass of each balancer is set so that such a relational expression is achieved (see FIG. 12).

However, in the multi-cylinder rotary compressor shown in either FIG. 10 or FIG. 11, the lower balancer 284 or 384 is required and a number of components is increased, which leads to increase in cost and weight, thereby deteriorating the productivity.

SUMMARY OF THE INVENTION

In order to solve the above-described technical problems in the prior art, an object of the present invention is to provide a multi-cylinder rotary compressor which can reduce a number of balancers for preventing the vibration.

That is, the present invention provides a multicylinder rotary compressor for accommodating in a closed container an electric element and a rotary compression element, the rotary compression element comprising: an intermediate partition plate; a second cylinder provided on the electric element side of the intermediate partition plate; a first cylinder provided on the opposite side of the intermediate partition plate; a rotating shaft which has eccentric portions whose rotating angles are shifted from each other 180 degrees and is connected to the electric element; rollers which are fitted to the respective eccentric portions of the rotating shaft and rotate in the respective cylinders; and bearings for closing the openings of the respective cylinders, the electric element comprising: a stator; and a rotator which is supported by the rotating shaft and rotatable on the inner side of the rotator, wherein assuming that the mass eccentricity in a first cylinder is m1×r1; the mass eccentricity in a second cylinder is m2×r2; the mass eccentricity of a first balancer attached to one end of the rotator on the rotary compression side is m3×r3; the mass eccentricity of a second balancer attached to the other end of the rotator is m4×r4; a distance from the first cylinder to the second cylinder, the first balancer and the second balancer is L2, L3 and L4, respectively, when the balance is attained with the following relationship:

$$m1\times r1+m4\times r4=m2\times r2+m3\times r3$$

$$m4\times r4L4=m2\times r2\times L2+m3\times r3\times L3$$

$$m1\times r1=m2\times r2$$

the first balancer is eliminated and the mass eccentricity of the second balancer is set to be not less than 20% and not more than 80% of m4×r4, and the maximum vibration displacement of the compressor in the radial direction can hence suppressed to not more than 1.3-fold of the prior art irrespective of elimination of the first balancer as shown in FIG. 9.

DETAILED DESCRIPTION OF THE PREFERRED EMBODIMENT

Figure 1:
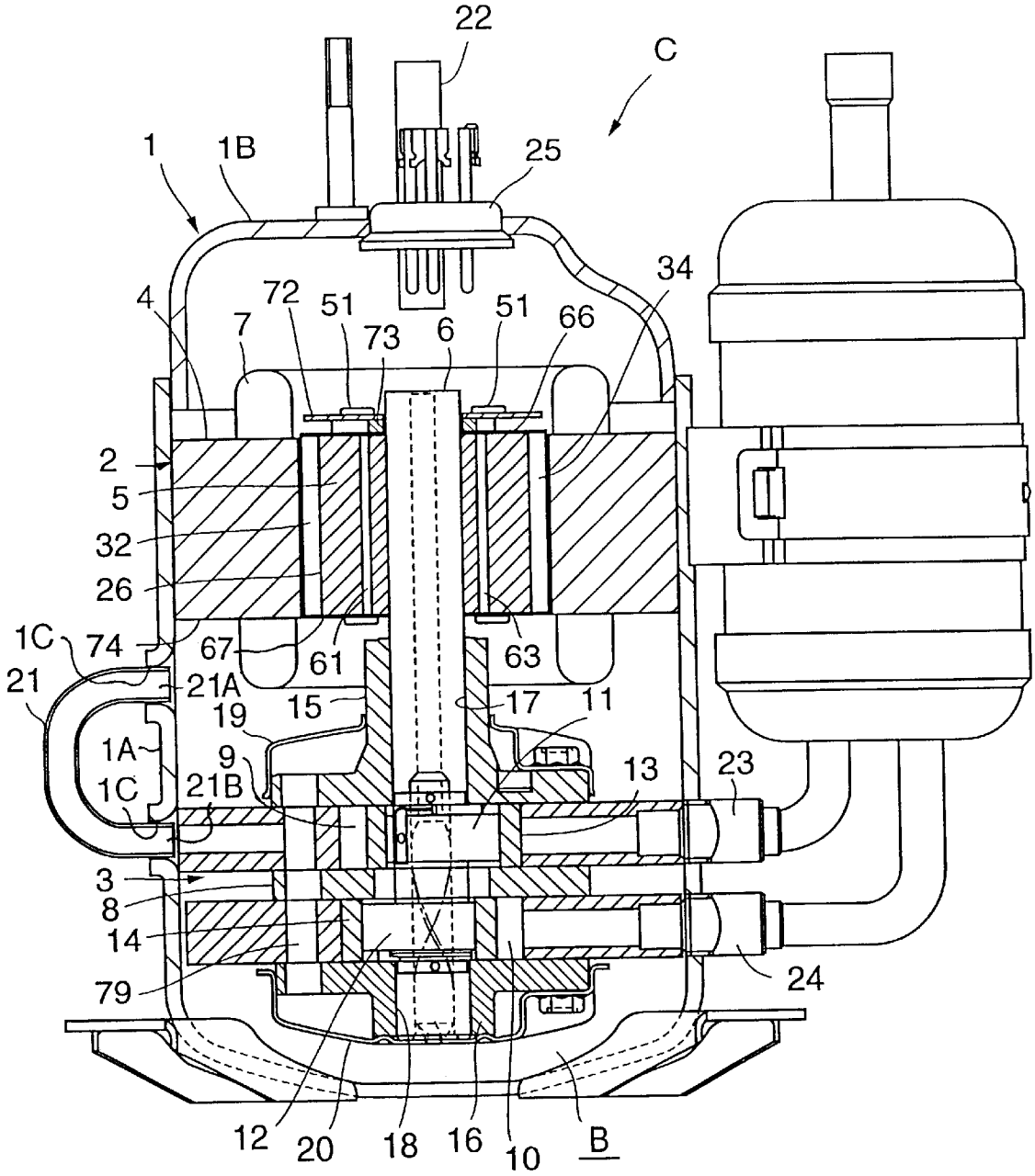
FIG. 1 is a longitudinal side sectional view showing a multi-cylinder rotary compressor according to one embodiment to which the present invention is applied.

An embodiment according to the present invention will now be described in detail hereunder with reference to the accompanying drawings. FIG. 1 is a longitudinal side sectional view of a multi-cylinder rotary compressor C to which the present invention is applied. In this drawing, reference numeral 1 denotes a cylindrical closed container in which an electric motor 2 is accommodated on the upper side as an electric element and a compression element 3 driven to rotate by the electric motor 2 is housed on the lower side.

The closed container 1 has a half-split structure consisting of a cylindrical shell portion 1A whose upper end is opened and an end cap portion 1B for closing the upper end opening of the shell portion 1A. Further, the closed container 1 is constituted by fitting the end cap portion 1B on the shell portion 1A to be sealed by high frequency deposition and the like after housing the electric motor 2 and the compression element in the shell portion 1A. In addition, a bottom portion in the shell portion 1A of the closed container 1 serves as an oil bank B.

Figure 3:
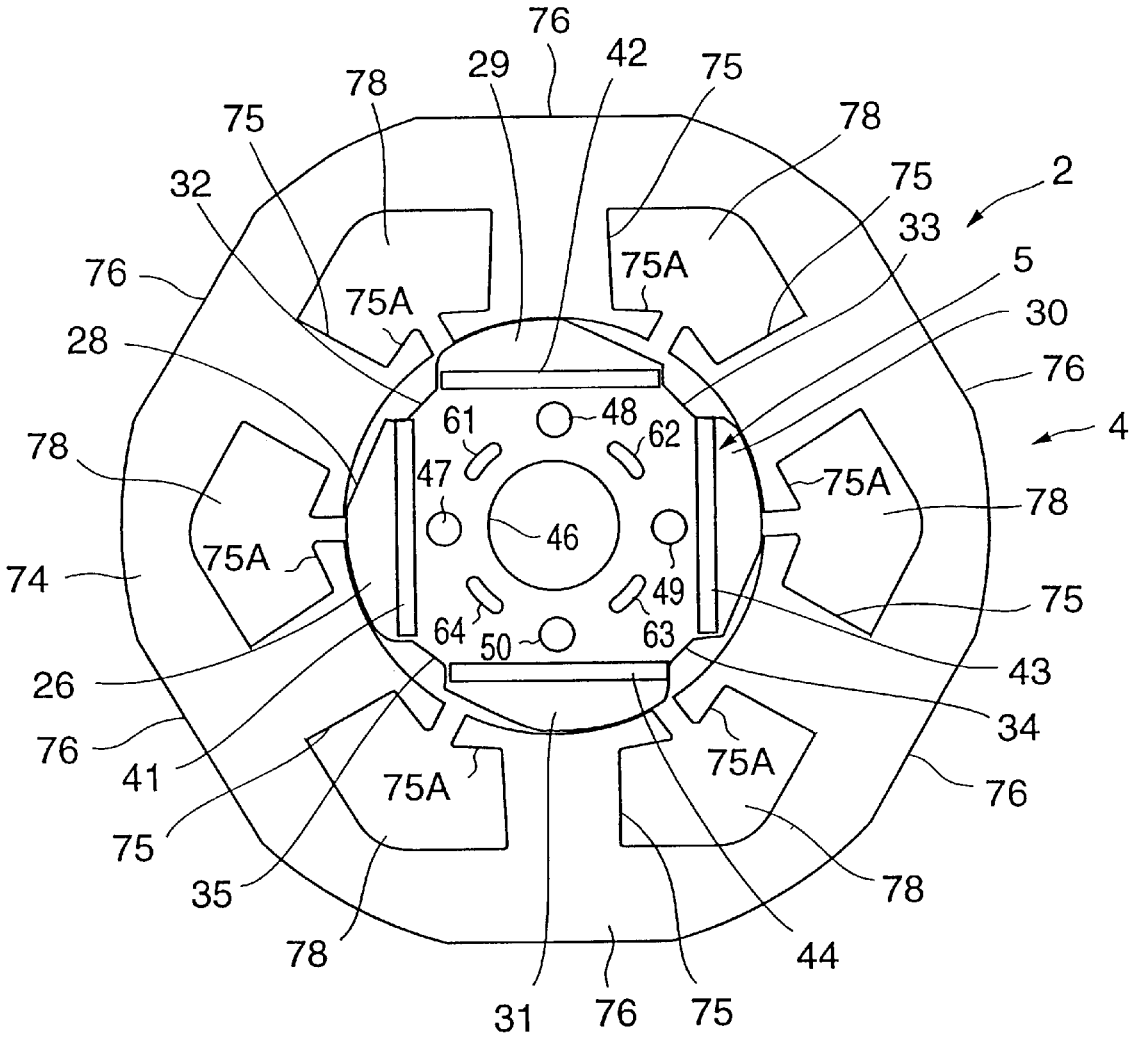
FIG. 3 is a plan view showing a stator core and a rotator core of the multi-cylinder rotary compressor illustrated in FIG. 1.

The electric motor 2 is a DC brushless motor of a so-called magnetic pole concentrated winding type and constituted by a stator 4 fixed to an inner wall of the closed container 1 and a rotator 5 which extends in the axial direction of the cylinder of the closed container 1 and is rotatable around a rotating shaft 6 on the inner side of the stator 4. The stator 4 includes a stator core 74 formed by superimposing a plurality of stator iron plates (silicon steel plates) having a substantially donut-like shape and a stator winding (driving coil) 7 for giving a rotating magnetic field to the rotator 5, as shown in FIG. 3.

In this case, six cog portions 75 are provided on the inner periphery of the stator core 74, and slot portions 78 opened in the inward and vertical directions are formed between the cog portions 75. Further, a tip portion 75A opened along the outer surface of the rotator 5 is formed at the end of the cog portion 75. When the stator winding 7 is directly wound around the cog portions 75 by utilizing the space of the slot portions 78, the magnetic poles of the stator 4 are formed by a so-called concentrated series winding method, thereby constituting the four-pole-six-slot stator 4.

Figure 2:
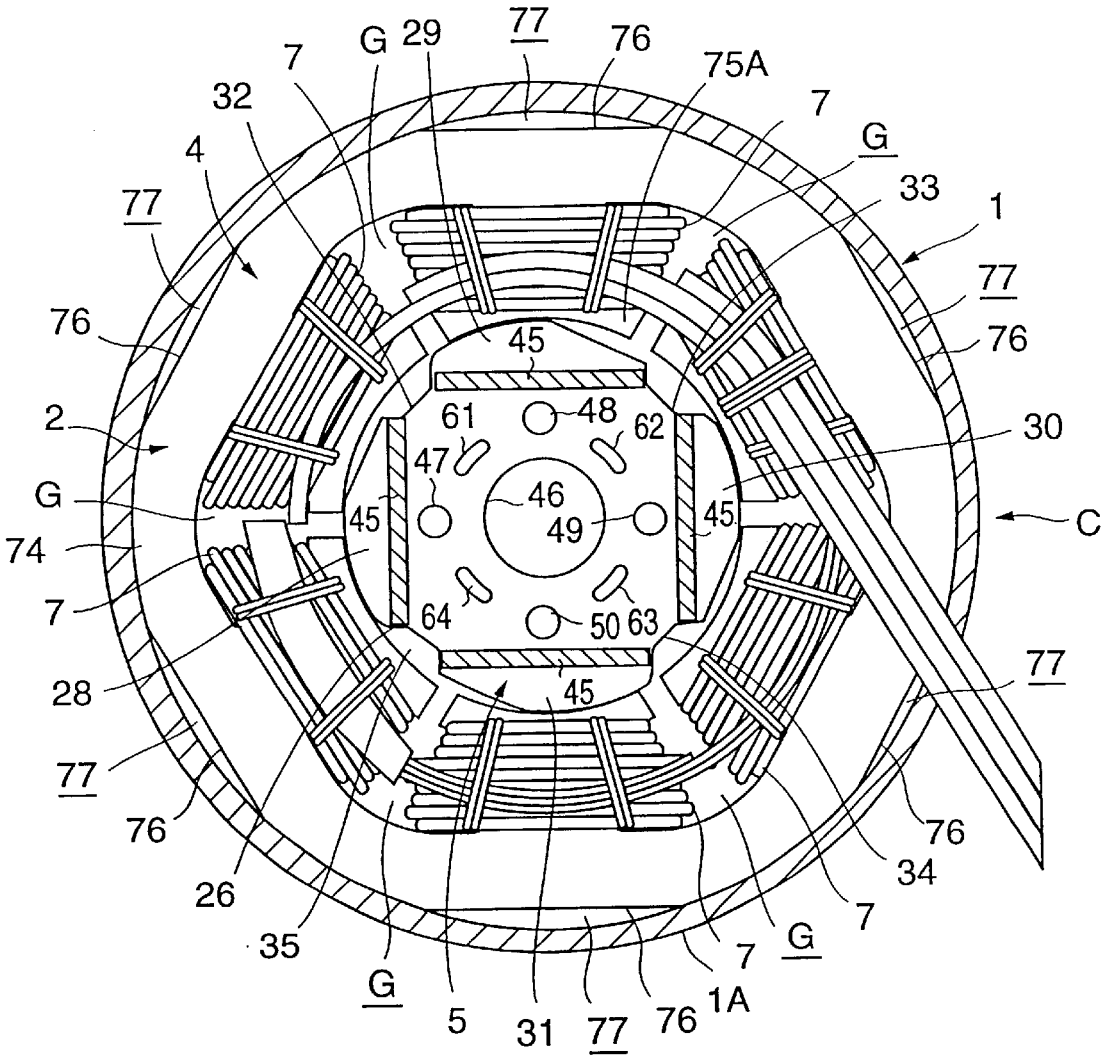
FIG. 2 is a plan cross sectional view of the multi-cylinder rotary compressor illustrated in FIG. 1.

By adopting such a DC brushless motor of the magnetic pole concentrated winding type as the electric motor 2, the dimension of the projecting part of the stator winding 7 from the stator core 74 in the vertical direction can be greatly reduced. Further, since the cross sectional area of the slot portion 78 of the stator core 74 also becomes large as shown in FIG. 3, the gap G which is formed inside the stator 4 and pierces in the vertical direction as shown in FIG. 2 is prominently increased.

The outer peripheral surface of the stator core 74 comes into contact with and fixed to the inner wall of the shell portion 1A of the closed container 1. In such a case, a plurality of notches 76 (six in this embodiment) obtained by carving the circumference in the chord-like form are formed on the outer peripheral surface of the stator core 74, and the notches 76 are estranged from the inner wall of the shell portion 1A so that the oil return passage 77 is constituted as will be described later.

On the other hand, the rotary compression element 3 is provided with a rotary cylinder 9 (a second cylinder) and a rotary cylinder 10 (a first cylinder) separated by an intermediate partition plate 8. Eccentric portions 11 and 12 driven to rotate by the rotating shaft 6 are attached to the respective cylinders 9 and 10, and the eccentric positions of these eccentric portions 11 and 12 are shifted from each other 180 degrees.

Reference numerals 13 and 14 denote rollers which rotate in the respective cylinders 9 and 10 by rotation of the eccentric portions 11 and 12. Reference numerals 15 and 16 designate first and second bearings, and the first bearing 15 forms a closed compression space of the cylinder 9 between itself and the partition plate 8 while the second bearing 16 similarly forms a closed compression space of the cylinder 10 between itself and the partition plate 8.

Furthermore, the first bearing 15 and the second bearing 16 respectively include bearing portions 17 and 18 which rotatably pivot the lower portion of the rotating shaft 6.

Reference numerals 19 and 20 represent cup mufflers which are attached so as to cover the first bearing 15 and the second bearing 16, respectively. It is to be noted that the cylinder 9 communicates with the cup muffler 19 through a non-illustrated communication hole provided to the first bearing 15, and the cylinder 10 likewise communicates with the cup muffler 20 through a non-illustrated communication hole provided to the second bearing 16. The inside of the cup muffler 20 on the lower side communicates with the cup muffler 19 on the upper side through a through hole 79 piercing the intermediate partition plate 8.

Further, openings 1C are formed on the side wall of the shell portion 1A on the side of the cylinder 9 and the side wall of the shell portion 1A on the side of the lower end of the stator winding 7. Un upper end opening 21A and a lower end opening 21B of the bypass pipe 21 are respectively inserted from the outer side of the closed container 1 into the openings 1C and welded and fixed to the shell portion 1A.

The lower end opening 21B of the bypass pipe 21 communicates with the inside of the cup muffler 20 through the through hole 79 in the cylinder 9, and the lower end of the upper end opening 21A is positioned below the lower end surface of the stator winding 7 of the stator 4.

Reference numeral 22 denotes a discharge pipe provided on the top of the closed container 1, 23 and 24, suction pipes respectively connected to the cylinders 9 and 10. Further, reference numeral 25 designates a closed terminal which supplies power from the outside of the closed container 1 to the stator winding 7 of the stator 4 (a lead wire connecting the closed terminal 25 to the stator winding 7 is not shown).

Reference numeral 26 represents a rotator core of the rotator 5 which is obtained by superimposing multiple rotator iron plates punched out from an electromagnetic steel plate having a thickness of 0.3 mm to 0.7 mm in such a shape as shown in FIGS. 2 and 3 and caulking them to be integrally layered.

In such a case, the rotator iron plate of the rotator core 26 is punched out from the electromagnetic steel plate in such a manner that salient pole portions 28 to 31 constituting four magnetic poles are formed, and reference numeral 32 to 35 denote concave portions provided such that salient pole portions are formed between the respective salient pole portions 28 to 31.

Reference numerals 41 to 44 designate slots into which a magnetic body 45 (a permanent magnet) is inserted.

These slots correspond to the respective salient pole portions 28 to 31 and are formed on a concentric circle along the axial direction of the rotating shaft 6 on the outer peripheral side of the rotator core 26.

In addition, reference numeral 46 denotes a hole which is formed in the center of the rotator core 26 and into which the rotating shaft 6 is shrinkage-fitted.

Reference numerals 47 to 50 represent through holes having a size allowing insertion of later-described caulking rivets 51 therethrough. These holes are formed in accordance with the inner side of the respective slots 41 to 44. Moreover, reference numerals 61 to 64 denote air holes for forming oil passages between the respective through holes 47 to 50. After superimposing the respective rotator iron plates, they are caulked each other to be integrated, thereby forming the rotator core 26.

On the other hand, the magnetic body 45 is made up of a rare earth magnet material such as a praseodymium based magnet or a neodymium based magnet whose surface is nickel-plated, and the outward form thereof has a rectangular shape as a whole with a rectangular cross section. The respective slots 41 to 44 has a size allowing insertion of the magnetic material 45 therethrough.

Figure 5:
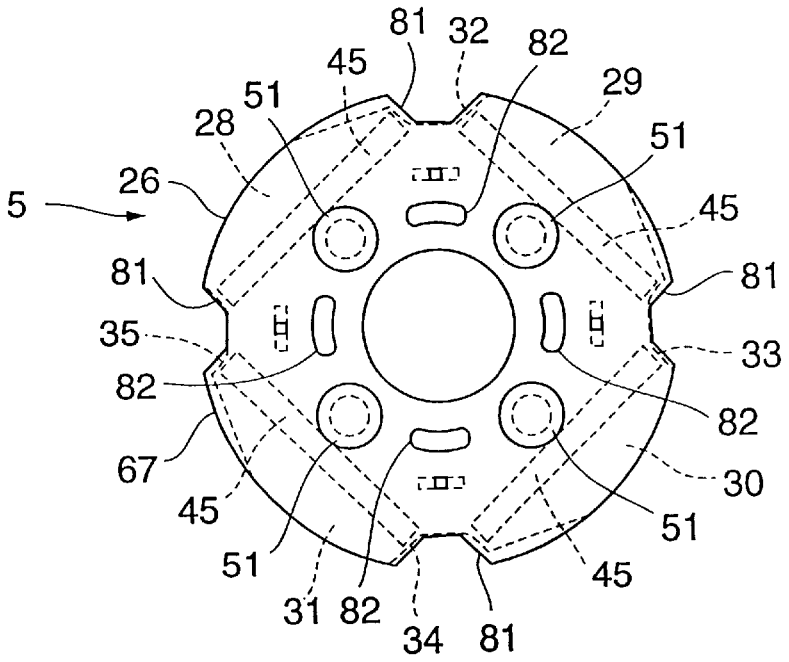
FIG. 5 is a bottom view of the rotator of the multi-cylinder rotary compressor illustrated in FIG. 1.

Reference numerals 66 and 67 designate tabular edge members attached to the upper and lower ends of the rotator core 26. These members are constituted by a nonmagnetic material such as stainless or brass. In these members, notch portions 81 are formed at positions corresponding to the concave portions 32 to 35 in such a manner that they have substantially the same shape as the stator core 26, and similar air holes 82 are formed at positions corresponding to the air holes 61 to 64 (FIG. 5).

Also, through holes are formed to the edge members 66 and 67 at positions corresponding to the through holes 47 to 50.

Figure 4:
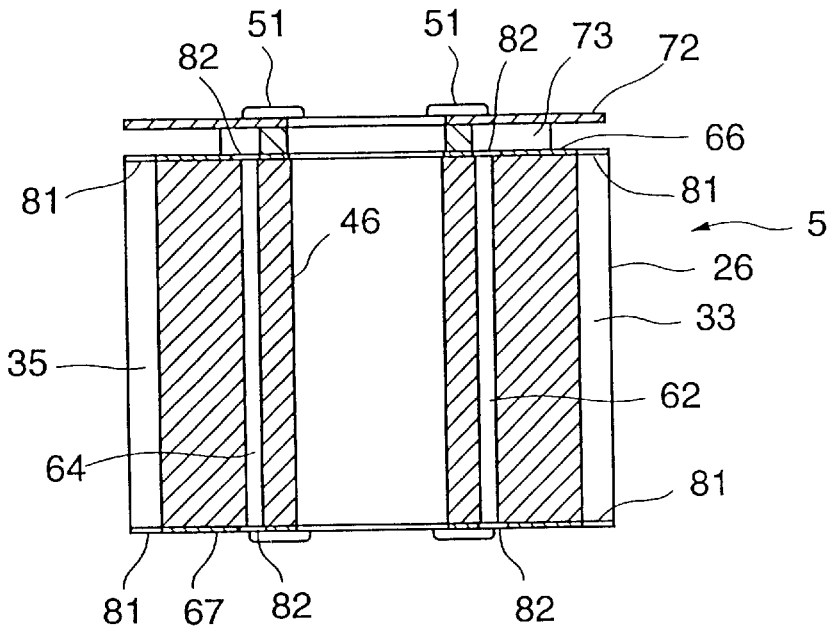
FIG. 4 is a longitudinal side sectional view showing a rotator of the multi-cylinder rotary compressor illustrated in FIG. 1.
Figure 6:
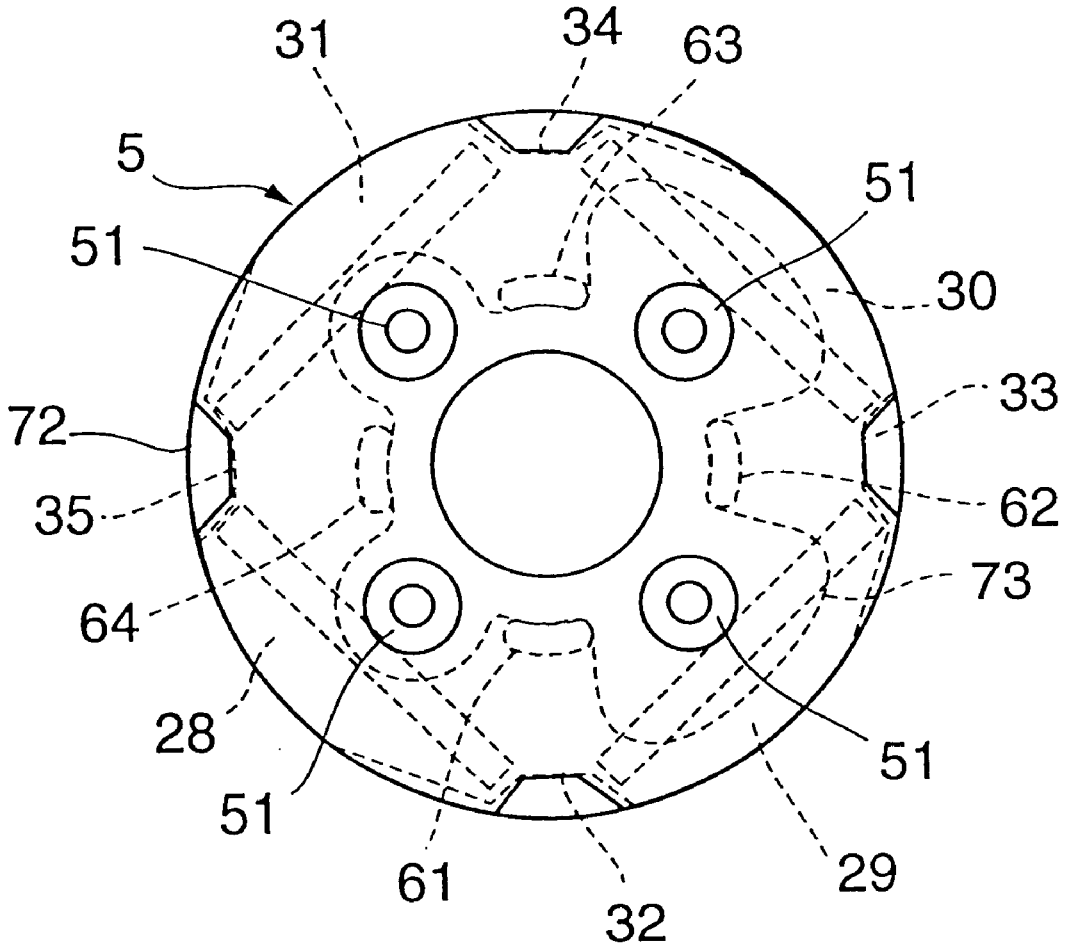
FIG. 6 is a top view of the rotator of the multicylinder rotary compressor illustrated in FIG. 1.

It is to be noted that reference numeral 72 designates a discoid oil separation plate attached to the rotator 5 at a position above the edge member 66, and 73, a balancer (a second balancer) attached between the plate 72 and the edge member 66 (see FIGS. 4 and 6).

With such a structure, when the stator winding 7 of the stator 4 of the electric motor 2 is energized, the rotating magnetic field is formed to rotate the rotator 5. Rotation of the rotator 5 causes eccentric rotation of the rollers 13 and 14 in the cylinders 9 and 10 through the rotating shaft 6, and the intake gas absorbed from the suction pipes 23 and 24 is compressed.

The compressed high pressure gas is emitted from the upper cylinder 9 into the cup muffler 19 through the communication hole and discharged from the discharge hole formed to the cup muffler 19 into the upper (a direction of the electric motor 4) closed container 101. On the other hand, the gas is emitted from the cylinder 10 into the cup muffler 20 through the communication hole. A part of this gas enters the cup muffler 19 via the through hole 79 to be discharged from the discharge hole, and the remaining part of the same enters the bypass pipe 21 from the lower end opening 21B and is discharged from the upper end opening 21A into the space (the space between the electric motor 2 and the rotary compression element 3) on the lower side of the electric motor 2 along the circumferential direction of the cylinder of the closed container 1.

The gas discharged into the closed container 1 passes each passage in the electric motor 2 to be discharged from the discharge pipe 22 to the outside. Further, the oil is separated by the plate 72 and passes the passage 77 to be fed back to the oil bank B.

Figure 7:
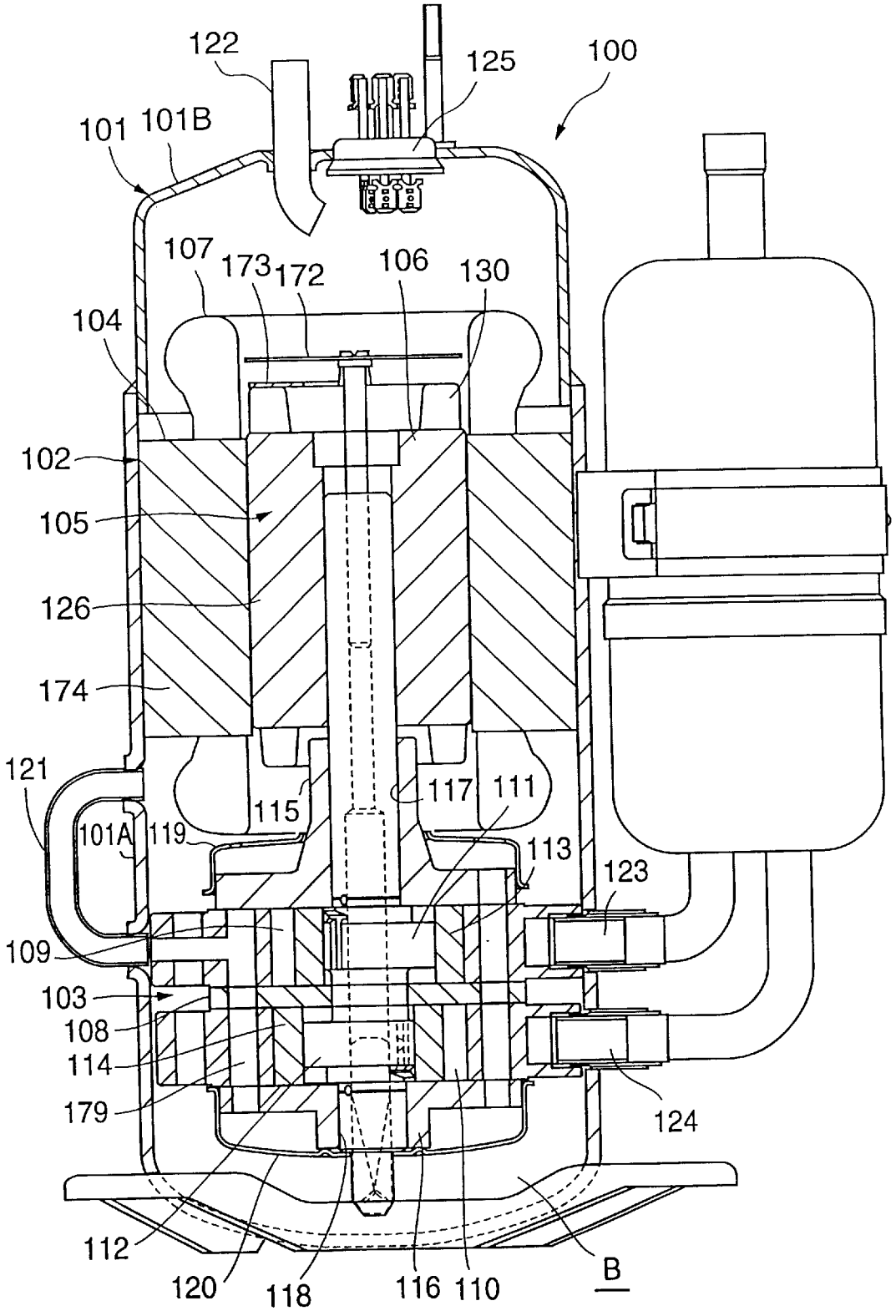
FIG. 7 is a longitudinal side sectional view showing a multi-cylinder rotary compressor according to another embodiment of the present invention.

FIG. 7 shows a multi-cylinder rotary compressor according to the embodiment using an AC motor as the electric motor. In this drawing, reference numeral 101 denotes a closed container in which an electric motor 102 composed of an AC motor (an induction motor) as an electric element is accommodated on the upper side and a compression rotary element 103 driven to rotate by the electric motor 102 is housed on the lower side. The closed container 101 has a half-split structure composed of a cylindrical shell portion 101A whose upper end is opened and an end cap portion 101B for closing the upper end opening of the shell portion 101A, and it is constituted by fitting the end cap portion 101B on the shell portion 101A to be closed by high frequency deposition and the like after accommodating the electric motor 102 and the compression element 103 in the shell portion 101A. Further, the bottom portion in the shell portion 101A of the closed container 101 is an oil bank B.

The electric motor 102 is constituted by a stator 104 fixed on the inner wall of the closed container 101, and a rotator 105 which is supported by a rotating shaft 106 extending in the axial direction of a cylinder of the closed container 101 and rotatable around the rotating shaft 106 on the inner side of the stator 104. The stator 104 is constituted by a stator core 174 configured by superimposing a plurality of stator iron plates having a substantially donut-like shape, and a stator winding 107 provided to a plurality of cog portions formed on the inner periphery of the stator core 174. The outer peripheral surface of the stator core 174 is brought into contact with and fixed to the inner wall of the shell portion 101A of the closed container 101.

The compression element 103 includes rotary cylinders 109 (a second cylinder) and 110 (a first cylinder) separated by an intermediate partition plate 108. Eccentric portions 111 and 112 driven to rotate by the rotating shaft 106 are attached to the respective cylinders 109 and 110, and the phases of these eccentric portions 111 and 112 are shifted from each other 180 degrees at the eccentric positions.

Reference numerals 113 and 114 designate a first roller and a second roller which rotate in the cylinders 109 and 110 respectively and turn in the cylinders by rotation of the eccentric portions 111 and 112. Reference numerals 115 and 116 denote first bearing and a second bearing, and the first bearing 115 forms a closed compression space for the cylinder 109 between itself and the intermediate partition plate 108 while the second bearing 116 similarly forms a closed compression space for the cylinder 110 between itself and the intermediate partition plate 108. Further, the first bearing 115 and the second bearing 116 respectively include bearing portions 117 and 118 which rotatably pivot the lower portion of the rotating shaft 106.

Reference numerals 119 and 120 represent cup mufflers which are disposed so as to cover the first bearing 115 and the second bearing 116, respectively. It is to be noted that the cylinder 109 communicates with the cup muffler 119 via a non-illustrated communication hole formed to the first bearing 115, and the cylinder 110 also communicates with the cup muffler 120 via a non-illustrated communication hole formed to the second bearing 116. The lower cup muffler 120 communicates with the inside of the closed container 101 above the cup muffler 119 through a through hole 179 piercing each bearing or cylinder and a bypass pipe 121 attached to the outside of the closed container 101.

Reference numeral 122 denotes a discharge pipe provided above the closed container 101, and reference numerals 123 and 124 represent suction pipes leading to the cylinders 109 and 110. Moreover, reference numeral 125 designates a closed terminal which supplies power from the outside of the closed container 101 to the stator winding 107 of the stator 104 (a lead wire connecting the closed terminal 125 to the stator winding 107 is not illustrated).

Reference numeral 126 represents a rotator core of the rotator 105 which is obtained by superimposing a plurality of rotator iron plates punched out from an electromagnetic steel plate having a thickness of 0.3 mm to 0.7 mm in a predetermined shape and caulking them each other to be integrally layered. Reference numeral 130 designates a rotary winding.

It is to be noted that reference numeral 172 represents a discoid oil separation plate attached to the rotating shaft 106 so as to be positioned above the rotator 105 and 173 designates an upper balancer (a second balancer) disposed to the top face of the rotating winding 130 projecting above the rotator 106.

With such a configuration, when the stator winding 107 of the stator 104 of the electric motor 102 is energized, the rotator 105 is rotated. Rotation of the rotator 105 causes eccentric rotation of the rollers 113 and 114 in the cylinders 109 and 110 through the rotating shaft 106, and an intake gas absorbed from the suction pipes 123 and 124 is compressed.

The compressed high pressure gas is emitted from the cylinder 109 into the cup muffler 119 through the communication hole and discharged from a discharge hole formed to the cup muffler 119 into the upper (a direction of the electric motor 102) closed container 101. On the other hand, the gas is emitted from the cylinder 110 into the cup muffler 120 through the communication hole and further discharged into the upper closed container 101 via the through hole 179 and the bypass pipe 121.

The discharged high pressure gas passes a gap in the electric motor 102 to reach the discharge pipe 122 and is discharged outside. On the other hand, although the oil is contained in the gas, this oil is separated by the plate 172 and others before reaching the discharge pipe 122 and directed to the outside by the centrifugal force. Further, it flows down to the oil bank B through the passage formed between the stator 104 and the closed container 101.

Meanwhile, in the above two embodiments, the mass and the attachment position of the balancer 73 or 173 attached on the upper side of the rotator 5 or 105 are set as follows.

Figure 12:
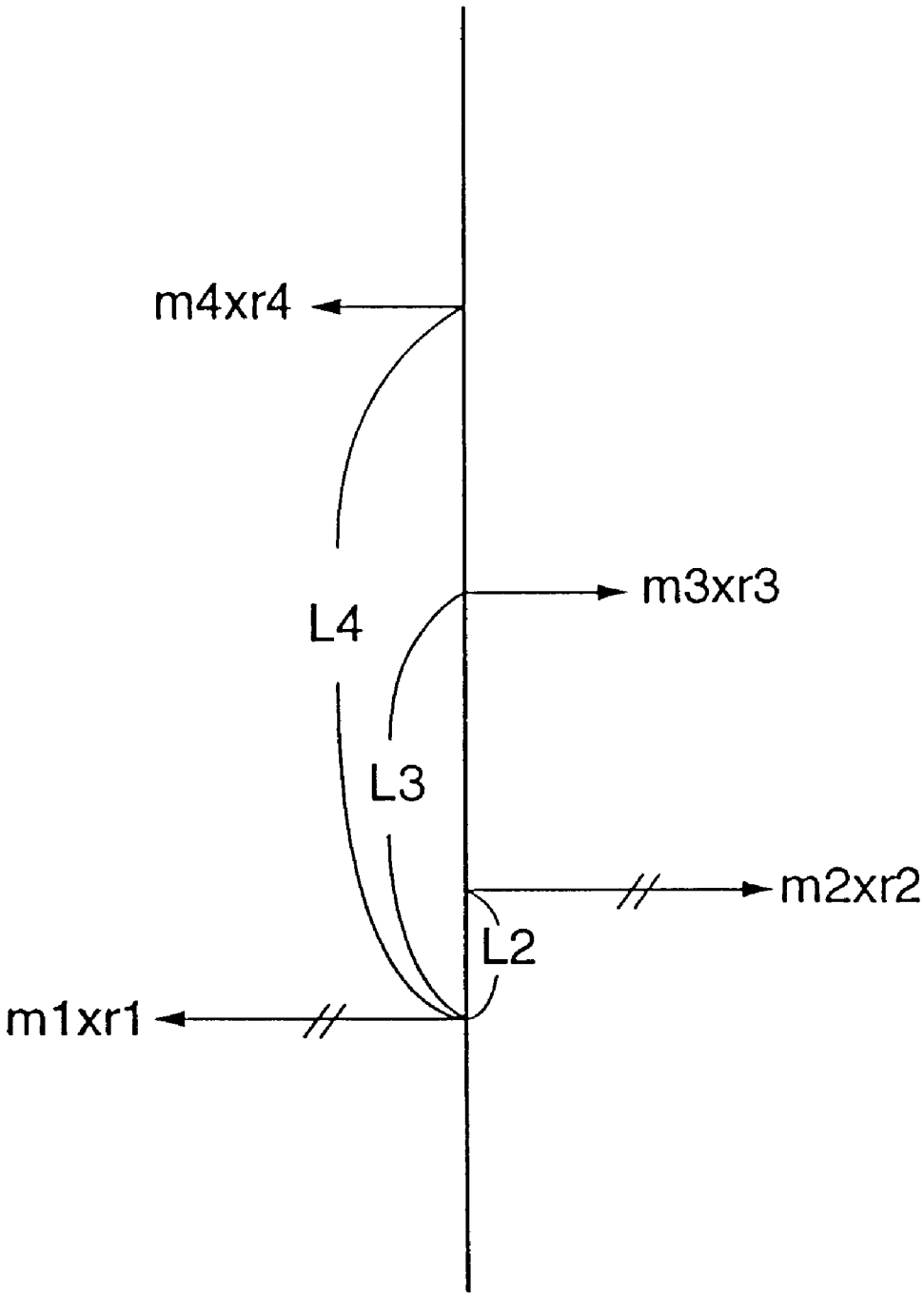
FIG.12 (Prior Art)
FIG. 12 is a view for explaining the relationship between mass eccentricities of the cylinder and the balancer in the conventional multi-cylinder rotary compressor.

That is, as the conventional multi-cylinder rotary compressor shown in FIG. 12, assuming that the mass eccentricity in the cylinder 10 or 110 in the multicylinder rotary compressor C or 100 is m1×r1; the mass eccentricity in the cylinder 9 or 109 is m2×r2; the mass eccentricity of the lower balancer which is supposed to be attached to one end of the rotator 5 or 105 positioned on the side of the rotary compression element 3 or 103 is m3×r3; the mass eccentricity of the balancer 73 or 173 in this case is m4×r4; the respective distances from the cylinder 10 or 110 to the cylinder 9 or 109, the lower balancer and the balancer 73 or 173 are L2, L3 and L4, the balancing is attained with the following expressions.

$$m1\times r1+m4\times r4=m2\times r2+m3\times r3 \quad (1)$$

$$m4\times r4\times L4=m2\times r2\times L2+m3\times r3\times L3 \quad (2)$$

$$m1\times r1=m2\times r2 \quad (3)$$

In such a case, the mass eccentricity of the balancer 73 or 173 is set to be not less than 20% and not more than 80% of the above m4×r4 (ratio X).

Figures 8, 9:
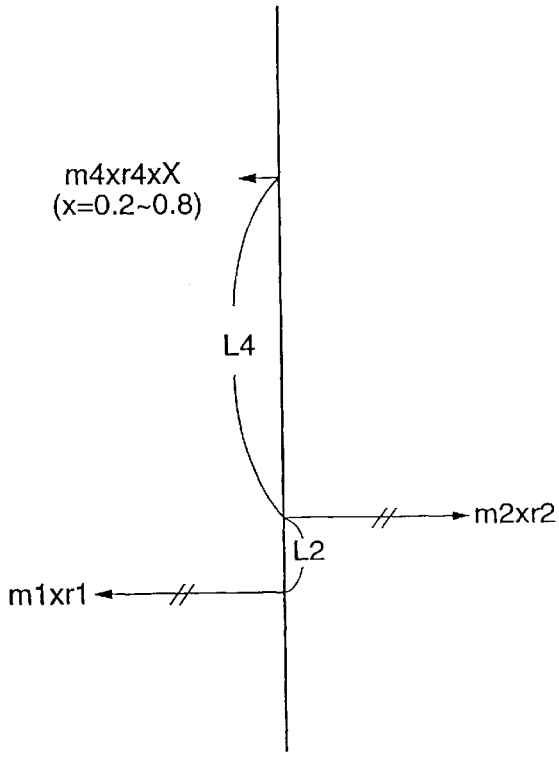
FIG. 8 is a view for explaining the relationship between mass eccentricities of a cylinder and a balancer in the multi-cylinder rotary compressor according to the present invention.
FIG. 9 is a view for explaining a change in the radial maximum vibration displacement of the multi-cylinder rotary compressor according to the present invention when the mass eccentricity of the balancer on the upper side of the rotator is varied.
Figure 10:
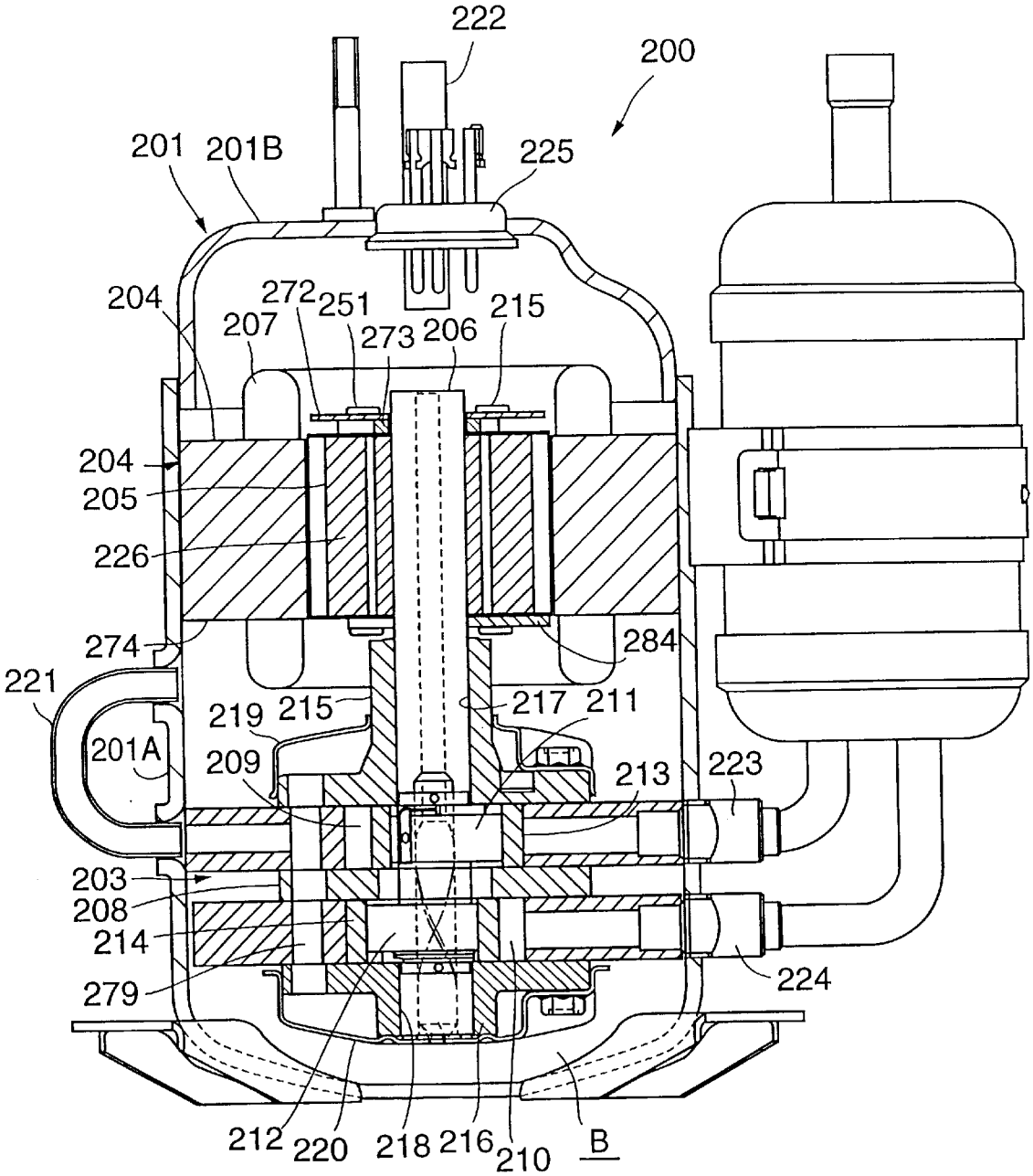
FIG.10 (Prior Art)
FIG. 10 is a longitudinal side sectional view of a prior art multi-cylinder rotary compressor.
Figure 11:
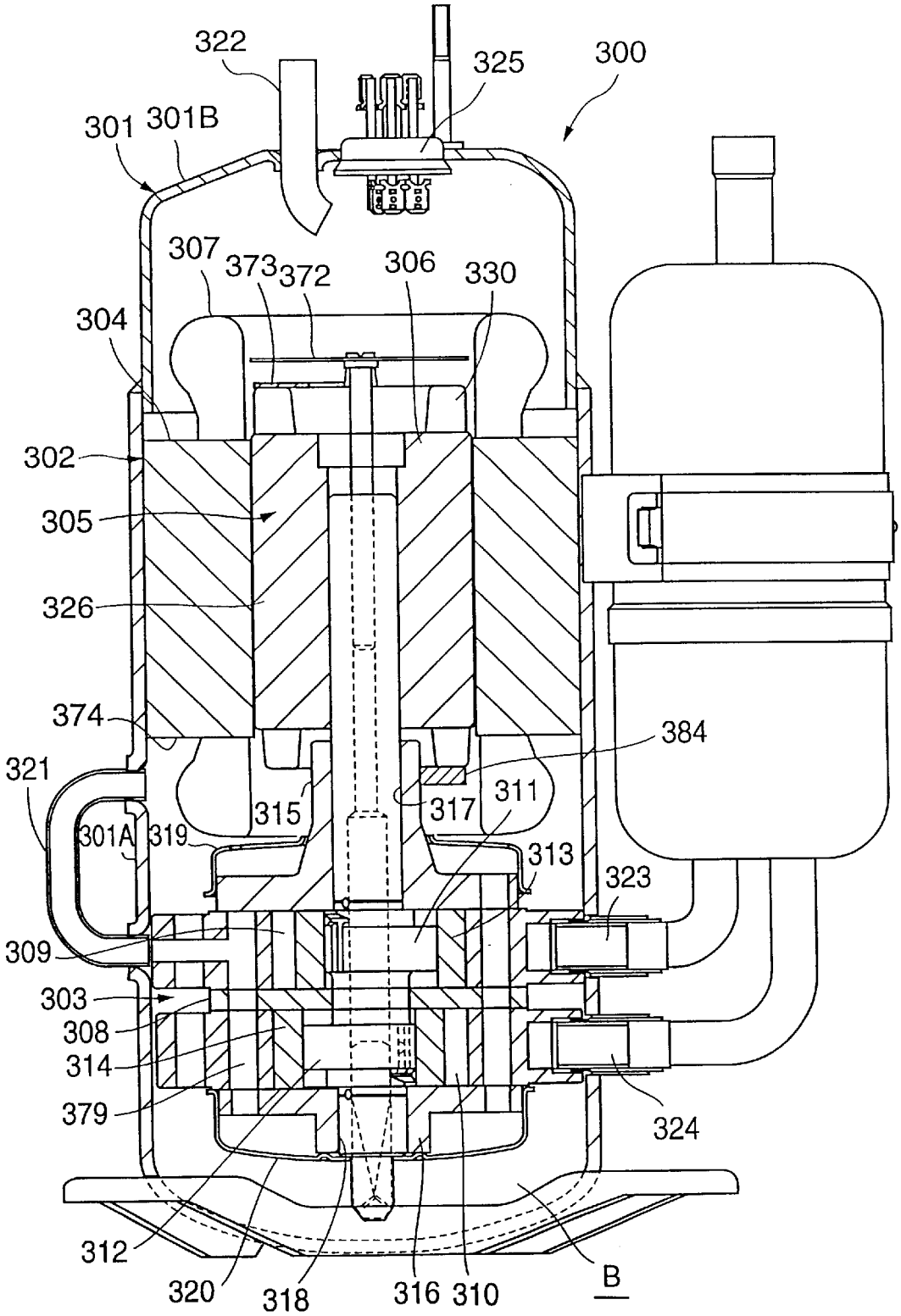
FIG.11 (Prior Art)
FIG. 11 is a longitudinal side sectional view of another prior art multi-cylinder rotary compressor.

Here, FIG. 9 shows a radial maximum vibration displacement of the compressor C (100) in the cases where the ratio X of the mass eccentricity of the balancer 73 (173) is changed in the form of the ratio provided that the conventional compressor (200, 300) shown in FIG. 10 or 11 is 1.

As apparent from this drawing, assuming that the ratio X is not less than 20% and not more than 80%, the radial maximum vibration displacement of the compressor can be suppressed to 1.3-fold or less of the prior art irrespective of the lower balancer (284 in FIG. 10, 384 in FIG. 11) of the rotator 5 (105). That is, according to the present invention, increase in the vibration/noise can be minimized while reduction in a number of components and weight can be achieved, and improvement in the productivity can be also realized.

As described above, according to the present invention, in the multi-cylinder rotary compressor in which the electric element and the rotary compression element are accommodated in the closed container, the rotary compression element comprising: the intermediate partition plate; the second cylinder provided on the electric element side of the intermediate partition plate; the first cylinder provided on the opposed side of the intermediate partition plate; the rotating shaft which has the eccentric portions whose rotating angles are shifted from each other 180 degrees and is connected to the electric element; the rollers which are fitted to the respective eccentric portions of the rotating shaft and rotate in the respective cylinders; and the bearings for closing the openings of the respective cylinders, the electric element comprising: a stator; and a rotator which is supported by the rotating shaft and rotatable on the inner side of the stator, assuming that the mass eccentricity in the first cylinder is m1×r1; the mass eccentricity in the second cylinder is m2×r2; the mass eccentricity of the first balancer attached to one end of the rotator positioned on the side of the rotary compression element is m3×r3; the mass eccentricity of the second balancer attached to the other end of the rotator is m4×r4; the respective distances from the first cylinder to the second cylinder, the first balancer and the second balancer are L2, L3 and L4, the balancing is attained with the following expressions.

$$m1\times r1+m4\times r4=m2\times r2+m3\times r3$$

$$m4\times r4\times L4=m2\times r2\times L2+m3\times r3\times L3$$

$$m1\times r1=m2\times r2$$

In such a case the first balancer is eliminated and the mass eccentricity of the second balancer is set to be not less than 20% and not more than 80% of m4×r4. Thus, the radial maximum vibration displacement of the compressor can be suppressed to be not more than 1.3-fold of the prior art irrespective of elimination of the first balancer as shown in FIG. 9.

That is, according to the present invention, increase in the vibration/noise can be minimized while reduction in a number of components and weight can be achieved, and improvement in the productivity can be also realized.

What is claimed is:

1. A multi-cylinder rotary compressor for accommodating an electric element and a rotary compression element in a closed container, said rotary compression element comprising: an intermediate partition plate; a second cylinder provided on said electric element side of said intermediate partition plate; a first cylinder provided on the opposite side of said intermediate partition plate; a rotating shaft which has eccentric element portions whose rotating angles are shifted from each other 180 degrees and is connected to said electric element; rollers which are fitted to said respective eccentric portions of said rotating shaft and rotate in said respective cylinders; and bearing for closing openings of said respective cylinders;

said electric element comprising: a stator, and a rotator which is supported by said rotating shaft and rotatable on the inner side of said stator, and a balancer connected to said rotator;

wherein the mass eccentricity in said first cylinder is m1×r1 and the mass eccentricity in said second cylinder is m2×r2; and wherein assuming: (a) the mass eccentricity of a first balancer portion attached to one end of said rotator positioned on the side of said rotary compression element is m3×r3; (b) the mass eccentricity of a second balancer portion attached to the other end of said rotator is m4×r4; (c) respective distances from said first cylinder to said second cylinder, said first balancer and said second balancer are L2, L3 and L4;

and (d) balancing is attained with the following expressions:

$$m1\times r1+m4\times r4=m2\times r2+m3\times r3$$

$$m4\times r4\times L4=m2\times r2\times L2+m3\times r3\times L3$$

$$m1\times r1=m2\times r2,$$

then said balancer has said first balancer portion eliminated and the mass eccentricity of said second balancer portion is set to be not less than about 20% and not more than about 80% of m4×r4.

* * * * *